US006197170B1

(12) United States Patent
Yokogawa

(10) Patent No.: US 6,197,170 B1
(45) Date of Patent: Mar. 6, 2001

(54) RINGLESS-COLLECTOR CONDUCTOR ROLL

(75) Inventor: Hiroyuki Yokogawa, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/142,591

(22) PCT Filed: Feb. 13, 1998

(86) PCT No.: PCT/JP98/00591

§ 371 Date: Sep. 10, 1998

§ 102(e) Date: Sep. 10, 1998

(87) PCT Pub. No.: WO98/37262

PCT Pub. Date: Aug. 27, 1998

(30) Foreign Application Priority Data

Feb. 20, 1997 (JP) ..... 9-036261

(51) Int. Cl.[7] ..... C25B 9/00
(52) U.S. Cl. ..... 204/279; 204/280
(58) Field of Search ..... 204/279, 280; 205/151, 291, 293, 295

(56) References Cited

U.S. PATENT DOCUMENTS 4,036,337 * 7/1977 Arjalies et al. ..... 204/279
5,516,414 * 5/1996 Glafenhein et al. ..... 205/291

FOREIGN PATENT DOCUMENTS 49-115936 11/1974 (JP) .
49-128810 12/1974 (JP) .
1-74271 5/1989 (JP) .

* cited by examiner

*Primary Examiner*—Bruce F. Bell
(74) *Attorney, Agent, or Firm*—Kenyon & Kenyon

(57) ABSTRACT

An object of the present invention is to provide a conductor roll which obviates burning troubles caused by poor contact between the collector rings (C rings) and the roll shafts, which makes removal and installation of the C rings and operation of sliding contact adjustment unnecessary during the repairing operation of the roll body, and which extends the life of the sliding collector parts. The ringless-collector conductor roll according to the present invention comprises an electroplated Cu layer provided on the outer peripheral surface of the shaft ends of the conductor roll and having a Vickers hardness of at least 100 Hv, the electroplated Cu layer being directly contacted with brushes.

2 Claims, 1 Drawing Sheet

RINGLESS-COLLECTOR CONDUCTOR ROLL

TECHNICAL FIELD

The present invention relates to a conductor roll used in an electroplating apparatus.

BACKGROUND ART

Electroplating has heretofore been conducted by mounting collector rings (referred to as C rings hereinafter) on both shaft ends of a conductor roll (referred to as a CDR hereinafter), and applying a current through brushes. For the purpose of maintaining the plating stability and the stabilized operation, it is important to ensure the current-conducting properties in the collector portions while it is naturally important to maintain the surface properties of the CDR body directly contacted with a steel strip.

Conventional CDRs each have cast Cu-made C rings which are larger than the diameter of the steel-made roll shaft and which are mounted on the right and left roll shaft ends, and an electric current is applied to the C rings. The conventional CDRs, therefore, have the following problems (1) to (3).

(1) Poor contact between the C rings and the roll shaft often produces burning troubles of brushes, etc.

That is, application of a current to a poor contact portion formed by improper maintenance of the roll shaft, improper mounting of the C rings, or the like, results in generation of heat in a large quantity which makes the poor contact portion reach a high temperature. A thermal expansion difference between the C rings and the roll shaft arises because the materials are different. Since the amount of thermal expansion of the C rings is larger than that of thermal expansion of the roll shaft, the poor contact between the C rings and the roll shaft is worsened. The balance of currents uniformly flowing in the C rings mounted on the right and left roll shaft ends is destroyed due to the poor contact between the C rings and the roll shaft caused by such improper maintenance and mounting, and application of the currents. As a result, a large current flows on the C ring side which has a smaller contact resistance, and the brushes and the lead wires of the C ring side may be burned.

(2) The operation burden of removal and installation of the C rings, and adjustment of the sliding contact, becomes heavy during the repairing operation of the roll body.

(3) The life of the sliding collector parts, such as the C rings and the brushes, is short due to their wear.

DISCLOSURE OF INVENTION

An object of the present invention is to provide a ringless-collector conductor roll which obviates the burning trouble, which makes removal and installation of the C rings and adjustment of the sliding contact unnecessary, and which extends the life of the sliding collector parts.

In order to achieve the object mentioned above, the present invention provides a ringless-collector conductor roll comprising an electroplated Cu layer provided on the outer peripheral surface of the shaft ends of the conductor roll and having a Vickers hardness of at least 100 Hv, the electroplated Cu layer being directly contacted with brushes.

When the thickness of the electroplated Cu layer is too small, repairing of the Cu plating on the roll shaft becomes frequent. Accordingly, the thickness is preferably at least 3 mm. When the thickness of the electroplated Cu layer is too large, the conductor roll tends to become costly. Accordingly, the thickness is preferably up to 6 mm.

In addition, the Vickers hardness of the electroplated Cu layer is preferably at least 150 Hv, more preferably at least 200 Hv.

BEST MODE FOR CARRYING OUT THE INVENTION

Figure 1:
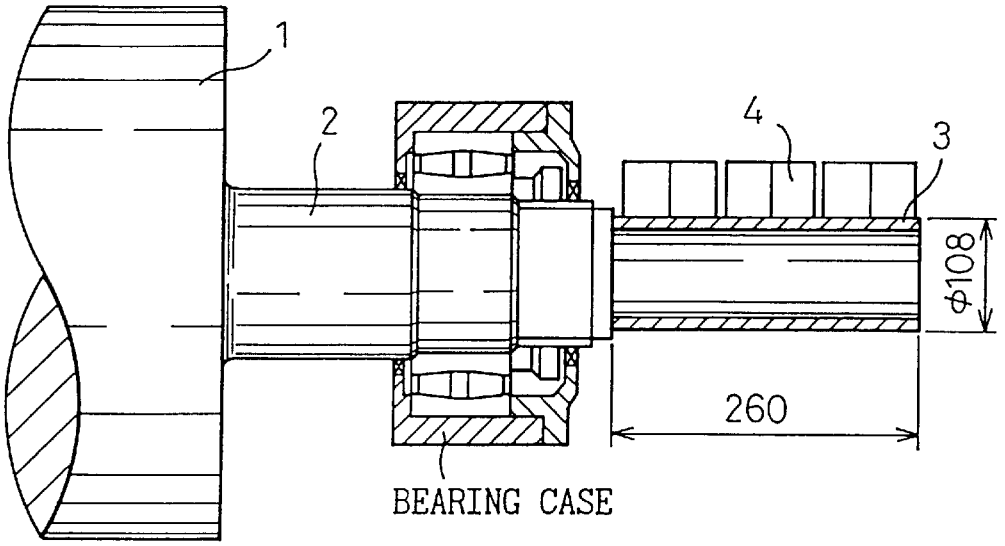
FIG. 1 shows one embodiment of a ringless-collector conductor roll of the present invention.

In the present invention, an electroplated Cu layer having an electric resistance as low as that of cast Cu is provided on the outer peripheral surface of the shaft ends of a conductor roll, and brushes are directly contacted with the plating portions, whereby direct application of a current is made possible without using the C rings.

When the electroplated Cu layer is provided on the outer peripheral surface of the shaft ends of a conductor roll, the Cu plating layer is firmly bonded to the outer peripheral surface of the roll shaft, and the contact resistance between the plating layer and the shaft during the application of a current is significantly lowered compared with that between the C rings and the roll shaft at the time when the C rings are mounted on the roll shaft.

As a result of a significant decrease in the contact resistance, heat generation caused by the application of a current is greatly decreased, and the temperature is also lowered. A difference between the thermal expansion of the roll shaft and that of the electroplated Cu layer thus becomes small, and peeling at the interface is prevented. Consequently, poor contact between the outer peripheral surface of the roll shaft and the electroplated Cu layer is effectively prevented during the application of a current.

Accordingly, burning trouble due to the unbalance between the flow of a current on the right shaft and that of a current on the left shaft caused by poor contact in the contact portion between the C rings and the roll shaft can be obviated. Moreover, the operation of removal and installation of the C rings, and adjustment of the sliding contact, during a repairing operation of the roll body, can be made unnecessary.

Furthermore, when the electroplated Cu layer is provided on the outer peripheral surface of the CDR shaft ends, the surface hardness (Vickers hardness) increases by about at least 200%, and the frictional resistance decreases to about up to a half compared with cast Cu (Vickers hardness: 35 to 50 Hv). Although reasons for the improvement of the surface hardness (Vickers hardness) by about at least 200% and the decrease of the frictional resistance to up to a half are not definite, the reasons may be inferred to be as described below. The difference is probably based on the fact that in the electroplated Cu layer, the crystalline structure of Cu constituting the Cu layer is formed by electron bonding and is dense compared to cast Cu in which the crystalline structure of Cu constituting cast Cu is coarse. Since the electroplated Cu layer has a high surface hardness and a low frictional resistance compared with the cast Cu-made C rings, the amount of wear caused by sliding diminishes when brushes are contacted with the C rings.

Furthermore, since the outer diameter of the roll shaft on which the electroplated Cu layer is provided is small compared with that of the C rings, the sliding distance per rotation of the CDR becomes small when the brushes are contacted with the Cu layer. The wear amount of the brushes can be diminished due to the decreased sliding distance in combination with the lowered frictional resistance mentioned above.

The type of the electrolyte used for forming the electroplated Cu layer is arbitrary so long as the electroplated Cu layer has a Vickers hardness of at least 100 Hv. Typical examples of the electrolyte are Cu sulfate, Cu pyrophosphate, Cu borofluoride and Cu cyanide. In addition, additives such as molasses, thiourea and thiodiazole may be added, if necessary, to the electrolytic solution in which such an electrolyte as mentioned above is used to improve the hardness of the electroplated Cu layer to be formed.

Furthermore, there is no specific limitation on the conditions of the electrolytic plating solution during the formation of the electroplated Cu layer on the outer peripheral surface of the roll shaft ends. The solution is usually satisfactory when the following conditions are satisfied: concentrations of the electrolytes: about 180 to 220 g/l of Cu sulfate and about 30 to 40 g/l of sulfuric acid; temperature of the electrolytic solution: 25 to 35° C.; and current density of about 3 to 10 A/dm$^2$.

In addition, the bonding strength between the shaft material steel and the Cu plating may be increased by forming a Ni plating layer which has a thickness of about 3 to 7 $\mu$m on the outer peripheral surface of the steel-made roll shaft ends and then forming a Cu plating layer as described above on the Ni plating layer.

EXAMPLES

Next, the ringless-collector conductor roll of the present invention will be explained in detail with reference to examples.

A conductor roll 1 having a shaft form shown in FIG. 1 was prepared. For the purpose of increasing the bonding strength between the shaft material steel and the Cu plating, a roll shaft portion 2 in FIG. 1 which was masked except for the outer peripheral surface was immersed in an electrolytic solution containing from 250 to 300 g/l of Ni sulfate, from 40 to 60 g/l of Ni chloride, and from 40 to 50 g/l of boric acid, and having a solution temperature of 55±1° C. and a pH of 3.8 to 4.8. Electroplating was then conducted at a current density of 4 A/dm$^2$ to form a Ni plating layer having a thickness of 5 $\mu$m on the outer peripheral surface. After washing with water, the roll shaft portion in FIG. 1 which was masked except for the outer peripheral surface was immersed in an electrolytic solution containing 200 g/l of Cu sulfate, 30 g/l of sulfuric acid, 40 mg/l of chlorine and 3 mg/l of a brightener and having a temperature of 30° C. Electroplating was then conducted at a current density of 8 A/dm$^2$ to form a Cu plating layer 3 having a thickness of 5 mm on the outer peripheral surface. A ringless-collector conductor roll (conductor roll A of the present invention) was thus obtained. Moreover, the procedure mentioned above was repeated except that electroplating with Ni was not conducted to form a Cu plating layer having a thickness of 5 mm on the outer peripheral surface of the roll shaft end. Another ringless-collector conductor roll (conductor roll B of the present invention) was thus obtained.

In order to examine the surface hardness of these Cu plating layers, the outer peripheral surface of a Cu bar having a diameter of 100 mm and a thickness of 15 mm was plated with Cu having a thickness of 5 mm under the electroplating conditions mentioned above to give a sample. The Vickers hardness of the sample was measured in accordance with JIS Z 2244. The hardness was 209 Hv.

Figure 2:
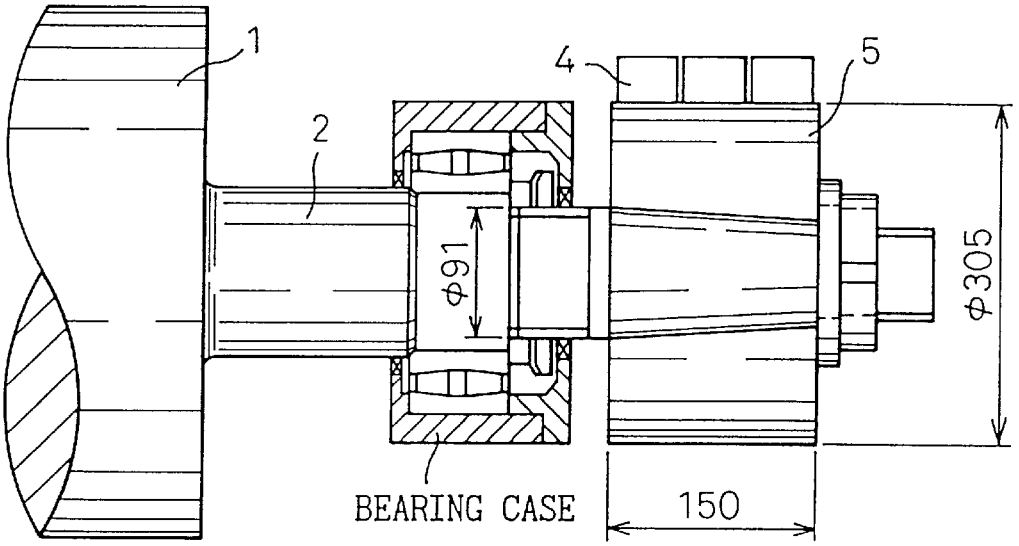
FIG. 2 shows one instance of a conventional conductor roll using collector rings.

On the other hand, a conductor roll 1 on which a collector ring 5 made of cast Cu was mounted on the shaft end was prepared as shown in FIG. 2. The same collector ring as mounted on the roll shaft was machined using a lathe and a shaper to give a sample, 10×20×20 mm. The Vickers hardness of the sample was measured in accordance with JIS Z 2244, and the sample had a Vickers hardness of 47 Hv.

Brushes 4 each having a contact area of 37×37 mm were used. For the conductor rolls A, B of the present invention in FIG. 1, four rows of 6 brushes each were arranged in the peripheral direction, and contacted with the electroplated Cu layer by applying a constant pressure. For the conventional conductor roll in FIG. 2, eight rows of 3 brushes each were arranged in the peripheral direction, and contacted with the collector ring by applying the same constant pressure. Measurements of a necessary rotation torque were made on the three rolls while the contact state of the brushes was maintained. As a result, the conductor rolls A, B of the present invention showed a torque of 3.5 kg-m, and the conventional roll showed a torque of 9.6 kg-m. Furthermore, the electric contact resistance between the shaft and the Ni layer (5 $\mu$m)–Cu layer (5 mm) of the conductor roll A in the present invention, and the resistance between the shaft (40 mm) and the C ring (5 mm) were measured. As a result, the contact resistance of the conductor roll A of the invention and that of the conventional conductor roll were $0.1\times10^{-6}$ (Ω) and $2\times10^{-6}$ (Ω), respectively.

The conductor rolls A, B of the present invention and the conventional conductor roll were each installed in a tin-electroplating line, and used for 5,600 hours (collecting current of 8,000 A per side). The surface temperature of Cu (° C.) in the contact portions contacted with the brushes, the wear amount of Cu (mm/day) and the wear amount of the brushes (mm/day) were examined. The results are as shown in FIG. 1.

TABLE 1

| | Surface temperature of Cu (° C.) | Wear amount of Cu (mm/day) | Wear amount of brushes (mm/day) |
|---|---|---|---|
| Conductor roll A of invention | 50 | 0.0027 | 0.0047 |
| Conductor roll B of invention | 48 | 0.0027 | 0.0047 |
| Conventional conductor roll | 85–90 | 0.0205 | 0.096 |

It is evident from Table 1 that the conductor rolls of the present invention show that the wear amount of Cu is diminished to ⅛ of that of Cu in the conventional roll, and that the wear amount of the brushes is diminished to 1/20 of that of the brushes therefor.

When the total wear amount of the brushes reaches a predetermined amount, the brushes are usually considered to be worn out, and are exchanged. The life of the brushes in the conductor roll of the present invention, therefore, amounts to about 20 times as much as that of the brushes in the conventional conductor roll. Moreover, the collector ring having a size shown in FIG. 2 ends its life and is exchanged when the wear amount reaches 7.5 mm. On the other hand, the thickness of the electroplated Cu layer on the ringless-collector conductor roll in FIG. 1 is 5 mm, and the conductor roll is electroplated again when the Cu plating layer is worn away. The life of the electroplated Cu layer is about 5 times as long as that of the collector ring in FIG. 2.

Furthermore, since the conductor roll of the present invention does not show the large electric contact resistance shown by the conventional conductor roll between the collector ring and the shaft, the Cu surface temperature of the conductor roll of the invention is significantly lowered compared with that of the conventional conductor roll.

When the conventional conductor rolls were used in a tin-electroplating line, the frequency of burning troubles of the brushes and lead wires was 4 times/year. When the conductor roll of the present invention was used, the frequency was reduced to zero.

Possibility of Utilization in Industry

The ringless-collector conductor roll of the present invention obviates burning troubles caused by poor contact between the C rings and the roll shafts, makes removal and installation of the C rings and operation of sliding contact adjustment unnecessary during the repairing operation of the roll body, and extends the life of the sliding collector parts.

What is claimed is:

1. A ringless-collector conductor roll comprising an electroplated Cu layer provided only on the outer peripheral surface of the shaft ends of the conductor roll and having a Vickers hardness of at least 100 Hv, the electroplated Cu layer being directly contacted with brushes.

2. The ringless-collector conductor roll according to claim 1, wherein the electroplated Cu layer has a thickness of 3 to 6 mm.

* * * * *